United States Patent [19]

Sulzbacher

[11] Patent Number: 4,566,902

[45] Date of Patent: Jan. 28, 1986

[54] PROCESS FOR REMOVING SULFUR DURING MELTING OF PIG IRON

[75] Inventor: Horst Sulzbacher, Leoben, Austria

[73] Assignee: Voest-Alpine Aktiengesellschaft, Vienna, Austria

[21] Appl. No.: 605,282

[22] Filed: Apr. 30, 1984

[30] Foreign Application Priority Data

May 4, 1983 [AT] Austria ..... 1646/83

[51] Int. Cl.[4] ..... C22B 1/10

[52] U.S. Cl. ..... 75/26; 75/43; 75/55

[58] Field of Search ..... 75/26, 38, 43, 55

[56] References Cited

U.S. PATENT DOCUMENTS 3,948,645 4/1976 Elvander et al. ..... 75/26

4,045,214 8/1977 Wetzel et al. ..... 75/38

*Primary Examiner*—Melvyn J. Andrews

*Attorney, Agent, or Firm*—Cushman, Darby & Cushman

[57] ABSTRACT

For removing sulfur during melting of pig iron in a fluidized coal layer, it is proposed to introduce into the fluidized coal layer lumpy and/or grainy desulfurating agent. The desulfurating agent can additionally be introduced into the slag, noting that the desulfurating agent is preferably charged above or laterally of the fluidized coal layer within a range of grain sizes of 0.5 to 5 mm for the fluidized coal layer and within a range of grain sizes of 5 to 50 mm for the slag layer. The proportion of lumpy desulfurating agent selected should preferably be smaller than 50% by weight of the total amount of desulfurating agent.

8 Claims, No Drawings

PROCESS FOR REMOVING SULFUR DURING MELTING OF PIG IRON

The invention refers to a process for removing sulfur when producing a melt of pig iron in a layer of fluidized coal.

For melting at least partially reduced iron ores, in particular iron sponge, processes have been proposed which are performed by using a melting gasifier in which the heat required for melting the reduced material and a reductive gas were produced by introducing coal and by blowing in an oxygen-containing gas. Such a melting process can be derived, for example, from published German patent application DE-OS No. 28 43 303. Such reduction processes were developed, above all, with respect to the utilization of carbon carriers having a relatively high sulfur content and being unsuitable for coking or having only a minor capability of being coked. With such procedures, a high sulfur content is introduced into the bath by the coal, and the sulfur content of the metal is, as a rule, substantially higher than the sulfur content of a comparable blast furnace pig iron. The reaction within such melting gasifiers proceeds relatively rapidly, and on account of the rapid throughput of material through the fluidized bed, there results, as a rule, only a low silicon content of below 0.2% and only a low content of FeO within the slag, which FeO content is higher than the FeO content of a blast furnace slag. Both of said facts adversely affect the desulfuration reaction with lime.

A sufficient desulfuration of pig iron obtained as a melt by such processes could thus be reasonably achieved only in the ladle and thus with additional energy consumption.

The invention now aims at avoiding such a separate desulfuration of the melt or heat, and at effecting the major part of the desulfuration or the whole desulfuration work already within the melting reactor. For solving this task, the invention essentially consists in that lumpy and/or granular desulfurating agent is introduced into the fluidized coal layer and optionally also into the slag layer. It has proved disadvantageous to use powdery fine lime in the form of hydrated lime or calcined limestone, because powdery fine lime is, for the major part, carried out together with the injected gas and only a minor amount is available for the desulfuration reaction within the melting space. When calcined limestone is used exclusively, it is only insufficiently dissolved within the usually acidic slag from the coal ash on account of the layer of dicalcium silicate formed on the grain surface. The use of grainy desulfurating agent within the fluidized coal layer makes it possible to effect a major part of the desulfuration already during the melting and reduction reactions within the fluidized phase, and the further addition of lumpy desulfurating agent, which is not completely reacted within the layer of fluidized coal, results in a further desulfuration by exchange phenomena taking place in the boundary reaching between the slag and the fluidized bed.

The desulfurating reaction with CaO is endothermic and is enhanced with increasing temperatures.

$$2CaO+2C+S_2=2CaS+2CO+Q$$

If the oxygen activity or the FeO content of the slag is high a detraction from the desulfurating efficiency has to be expected, primarily on account of the Si content of the molten metal being low.

On account of this fact and on account of the large amount of sulfur introduced by the coal, pig iron melted within the fluidized coal bed will show a distinctly higher sulfur content than pig iron obtained in a blast furnace. It is thus necessary to effect desulfuration outside of the melting receptacle with large specific amounts of the known desulfurating agents calcium carbide, sodium carbonate, magnesium and so on. According to the invention, the materials used for the subsequent desulfuration are now already introduced into the melting generator in lump and/or grainy form and fluidized in correspondence with their grain size together with the coal. They are combined in solid, liquid or sublimated condition with the sulfur of the coal or, in case of coarser grain size, fall immediately through the fluidized layer and dissolve slowly within the slag layer in intimate contact with the melting iron sponge. By varying the lumpy proportion and the grainy proportion of the desulfurating agent, the desulfurating reaction can be made to take place preferably either within the fluidized layer or within the slag layer.

When performing the process according to the invention, the desulfurating agent used can be manganese, calcium, magnesium, alkali metals or rare earth metals in the form of oxides, carbides, carbonates, alloys, mixed metals or in metallic form. The exclusive use of calcium carbonate is disadvantageous insofar as during direct charging of same into the gasifier, quite a considerable amount of energy is required for removing and reacting $CO_2$. According to the invention, the preferred desulfurating agent is thus calcium carbide. The desulfurating reaction by means of $CaC_2$ is accompanied by energy production and is enhanced with decreasing temperatures.

$$2CaC_2+S_2=2CaS+4C-Q$$

Calcium carbide also acts as a deoxidizing agent and thus results in a reduction of the FeO content of the slag. The reaction products CaO and CaS are consumed by the slag.

In comparison with desulfuration outside of the melting receptacle, the addition of lumpy and/or grainy desulfurating agents into the fluidized coal layer results, among other things, in an optimum distribution and in a long residence time of the desulfurating agent within the fluidized bed and, respectively, on the slag surface and thus in ideal kinetic premises.

There furthermore results the possibility of a control by the combined activation of the desulfurating spaces (fluidized bed for the desulfuration of coal and slag layer for desulfuration of iron). In this case, the grain size and the quality of the desulfurating agent play an important role. Such a possibility of control is achieved in an advantageous manner by introducing the proportion of the desulfurating agent for the fluidized coal bed in a range of grain sizes of 0.5 to 5 mm and the proportion of the desulfurating agent for the slag in the range of grain sizes of 5 to 50 mm, noting that both these proportions can be varied within broad limits and that in this manner the desulfuration reaction can be influenced to take place mainly within the fluidized bed or within the slag layer.

Further advantages resulting from the direct addition of lumpy and/or grainy desulfurating agent into the fluidized coal layer or onto the melt within the melting reactor, respectively, reside, in contrast to a desulfuration reaction outside of the reactor, in a better utilization of the desulfurating agent with respect to energy and amounts used. On account of the desulfurating process taking place simultaneously with the melting process, additional treatment time intervals and energy losses dependent thereon can at least substantially be reduced. The chemical energy (e.g. the carbon of $CaC_2$) introduced by the desulfurating agent is utilized better within a closed melting receptacle than within a ladle.

In advantageous manner, the procedure according to the inventive process is such that the grainy and the lumpy proportions of the desulfurating agent are charged above the fluidized coal layer or laterally of same. In this case, the desulfurating agent can, in a simple manner, be introduced together with coal, additives or materials recycled within the process.

For adjusting the most favorable grain sizes, it is advantageous if the desulfurating agent is at least partially introduced in agglomerated form.

In the following, the invention is further explained with reference to an embodiment. In a melting gasifier, 1000 kg coal per metric ton of pig iron were introduced. The sulfur content of the coal was 1.0%. The sulfur was composed of 60% sulfur combined in organic matter and of 40% inorganic sulfur (pyrite, sulfides, sulfur of sulfates). The major part of inorganic sulfur was set free during degassing of the coal and entered the reductive gas. The residual sulfur, approx. 6 to 7 kg/metric ton of pig iron, was gasified (sulfur vapor, $SO_2$, COS) during the combustion in front of the nozzles or during gasifying of the coked coal, respectively. During fluidizing, the gaseous sulfur came into contact with the fine grains of $CaC_2$ and was combined to form CaS. In this manner, approximately 4 kg S were combined in the form of CaS. The residual amount of 3 kg was absorbed either by the lime added or by the hot iron sponge which fell through the fluidized bed. The iron sponge containing FeS was subsequently desulfurated by the lumpy calcium carbide floating on the slag surface.

Based on a degree of utilization of 80% of the calcium carbide used, there resulted, in consideration of the reaction equation $$12 \text{ kg } CaC_2 + 6 \text{ kg } S = 13.5 \text{ kg } Cas + 4.5 \text{ kg } C,$$

a requirement of 15 kg $CaC_2$, $\frac{2}{3}$ of which was charged in grainy form and $\frac{1}{3}$ of which was charged in lumpy form.

The reaction product CaS was dissolved in the slag. Depending on the specific amount of slag, the sulfur content of the slag was between 2% and 3% and the sulfur content of the pig iron was 0.1%.

What is claimed is:

1. A process for removing sulfur during the melting of pig iron within a fluidized layer comprising introducing a desulfurating agent into the fluidized layer of sulfur-containing coal and pig iron, the desulfurating agent comprising a first grain size of 0.5 to 5 mm to selectively remove sulfur from the coal in the fluidized layer and a second grain size of 5 to 50 mm which passes through the fluidized layer to contact and thereby desulfurize the resulting molten slag.

2. Process as claimed in claim 1, characterized in that the desulfurating agent are charged above the fluidized coal layer or laterally into this layer.

3. Process as claimed in claim 1, characterized in that the desulfurating agent is introduced together with coal, additives or materials recycled within the process.

4. Process as claimed in claim 1, characterized in that the desulfurating agents are at least partially introduced in agglomerated form.

5. Process as claimed in claim 1, characterized in that a mixture of several desulfurating agents is introduced in the form of granulates or agglomerates.

6. Process as claimed in claim 1, characterized in that said second grain desulfurating agents is between 0% and 50% of the total amount of desulfurating agents.

7. Process as claimed in claim 1, characterized in that the desulfurating agent is as a whole or partially charged together with the ore.

8. Process as claimed in claim 1, characterized in that manganese, calcium, magnesium, alkali metals or rare earth metals in the form of oxides, carbides, carbonates, alloys or in metallic form are used as the desulfurating agent.

* * * * *